US012595926B2

(12) United States Patent
Soo

(10) Patent No.: US 12,595,926 B2
(45) Date of Patent: Apr. 7, 2026

(54) CONTROLLER AND METHOD FOR MANAGING A FLOW UNIT

(71) Applicant: Siemens Industry, Inc., Alpharetta, GA (US)

(72) Inventor: Ryan Soo, Chicago, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 396 days.

(21) Appl. No.: 18/476,806

(22) Filed: Sep. 28, 2023

(65) Prior Publication Data

US 2025/0109873 A1 Apr. 3, 2025

(51) Int. Cl.
*F24F 11/48* (2018.01)
*F24F 11/74* (2018.01)
*F24F 110/40* (2018.01)

(52) U.S. Cl.
CPC ..... *F24F 11/48* (2018.01); *F24F 11/74* (2018.01); *F24F 2110/40* (2018.01)

(58) Field of Classification Search
CPC ..... F24F 11/48; F24F 11/74; F24F 2110/40; F24F 2110/00; F24F 2140/00; F24F 11/46; F24F 11/49; F24F 11/0001; F24F 11/30; G01F 1/363; G01F 15/003; G01F 25/10; G05D 7/0664; G05D 7/0635
See application file for complete search history.

(56) References Cited

U.S. PATENT DOCUMENTS

| | | | | |
|---|---|---|---|---|
| 4,838,483 | A | 6/1989 | Nurczyk et al. | |
| 6,430,985 | B1 * | 8/2002 | Drees | G01F 1/363 702/100 |
| 9,810,462 | B2 * | 11/2017 | Douglas | F24F 11/63 |
| 11,429,121 | B2 * | 8/2022 | Karamanos | G01F 15/005 |
| 11,536,483 | B1 * | 12/2022 | Jaber | G05B 19/042 |
| 2008/0221822 | A1 | 9/2008 | Laverdiere et al. | |
| 2011/0264280 | A1 | 10/2011 | Grabinger | |
| 2013/0068313 | A1 * | 3/2013 | George | F16K 37/0041 137/487.5 |
| 2013/0161403 | A1 * | 6/2013 | Douglas | F24F 11/52 236/49.3 |
| 2013/0282186 | A1 * | 10/2013 | Douglas | F24F 11/52 700/277 |

(Continued)

FOREIGN PATENT DOCUMENTS

WO 02066903 A1 8/2002

*Primary Examiner* — Alicia M. Choi

(57) ABSTRACT

There is described a controller and method for managing a flow unit. A measured pressure drop corresponding to a full open position of a flow control element is detected. A calibration pressure drop at full open is established based on the measured pressure drop, and relative pressure drops are calculated based on the calibration pressure drop at full open and calibration pressure drops corresponding to calibration positions of the element. Subsequent to calibration, an operation pressure drop of the flow unit and an operation position of the element are detected. A dynamic nominal is determined based on the operation pressure drop and a particular relative pressure drop corresponding to the operation position. An operation relative flow and a relative flow setpoint are determined based, in part, on the dynamic nominal. The operation position of the flow control element is controlled based the operation relative flow and relative flow setpoint.

17 Claims, 5 Drawing Sheets

(56) References Cited

U.S. PATENT DOCUMENTS

| | | | | |
|---|---|---|---|---|
| 2014/0041401 | A1* | 2/2014 | Douglas | F25B 43/00 62/89 |
| 2014/0373826 | A1* | 12/2014 | Cote | F24D 19/1084 126/110 A |
| 2015/0057816 | A1 | 2/2015 | Schick et al. | |
| 2016/0131381 | A1* | 5/2016 | Schmidlin | F24F 11/80 700/277 |
| 2018/0209675 | A1* | 7/2018 | Ridder | F24F 3/001 |
| 2020/0363087 | A1 | 11/2020 | Mowris et al. | |
| 2021/0215379 | A1 | 7/2021 | Mehta | |
| 2022/0010972 | A1* | 1/2022 | Hamp | G05B 19/042 |
| 2022/0129020 | A1 | 4/2022 | Gundlach et al. | |
| 2022/0137649 | A1 | 5/2022 | Karamanos et al. | |

* cited by examiner

CONTROLLER AND METHOD FOR MANAGING A FLOW UNIT

FIELD OF THE INVENTION

This application relates to the field of controllers for flow units and, more particularly, to a controller for managing a flow control element of a flow unit based on nominal flow.

BACKGROUND

Building automation systems encompass a wide variety of building devices that aid in the monitoring and control of various aspects of building operation. Building devices managed by a building automation system include security units, fire safety units, lighting units, and heating, ventilation, and air conditioning ("HVAC") unit. For example, the system may manage many building devices of an HVAC unit dispersed about a facility by co-locating and coupling a controller of the building automation system with the devices.

A building device may be optimized for a fixed system design condition by control tuning the device with a fixed nominal setpoint. However, a fixed nominal setpoint does not work well with systems that reset the design condition to optimize for other conditions, such as energy efficiency.

Conventional systems attempt to provide a "best fit" controller tuning to the variable design conditions of the building devices. Typically, a technician chooses between over cycling the actuator and slow control reaction. For example, for an airflow control using a damper, the controller coupled to the damper is tuned with the system at the upper end of the design operating condition range. The controller will respond in a timely manner to errors when the system is on the upper end of the design condition range but will be slow to react when the system is in the lower end of the design condition range.

A Venturi air valve is able to self-adjust for changing system conditions as long as the differential pressure drop across the Venturi air valve is kept within the design pressure range. An airflow nominal for a Venturi valve is the maximum airflow listed on the Venturi valve for that specific configuration. Unfortunately, the performance of the Venturi air valve comes at a higher energy operating cost for the system.

SUMMARY

In accordance with one embodiment of the disclosure, there is provided a dynamic calculation of nominal flow approach for building automation systems. The approach provides consistent control performance despite changing dynamic conditions, such as a static pressure reset of an air handler unit, which affect the nominal setpoint. The system, or a technician, may tune the control loop at any system condition and ensures equivalent performance across a wide range of system condition. The system also provides that the default control loop parameters may be applied to a wide range of system conditions to minimize the amount of tuning for high performance systems. For systems that don't require high performance, the system eliminates any need for loop tuning while maintaining desirable control performance.

One aspect is a controller for managing a flow unit comprising an input component, a processor, and an output component. The input component detects a measured pressure drop across a flow control element of the flow unit at a maximum open position and detects an operation measured pressure drop of the flow unit and an operation position of the flow control element. The processor establishes a calibration pressure drop at full open based on the measured pressure drop across the flow control element of the flow unit at the maximum position and determines calibration relative values based on the calibration pressure drop at full open and calibration measured values corresponding to different calibration positions of the flow control element. The processor also determines a dynamic nominal based on the operation measured pressure drop and a particular calibration value of the calibration values corresponding to the operation position of the flow control element. The processor further determines an operation relative flow based on the operation measured pressure drop and the dynamic nominal and determines a relative flow setpoint based on a current flow setpoint and the dynamic nominal. The output component controls the operation position of the flow control element based on the operation relative flow and the relative flow setpoint.

Other aspects are a method of a controller for managing the flow unit and a non-transitory computer readable medium including executable instructions which, when executed, causes at least one processor to manage the flow unit. The controller of the flow unit is calibrated. A measured pressure drop across a flow control element of the flow unit at a maximum open position is detected. A calibration pressure drop at full open is established based on the measured pressure drop across the flow control element of the flow unit at the maximum open position. Calibration relative values are calculated based on the calibration pressure drop at full open and calibration measured pressure drops corresponding to calibration positions of the flow control element. The controller of the flow unit is also operated subsequent to being calibrated. An operation measured pressure drop of the flow unit and an operation position of the flow control element are detected. A dynamic nominal is determined based on the operation measured pressure drop and a particular calibration value of the calibration values corresponding to the operation position of the flow control element. An operation relative flow is determined based on the operation measured pressure drop and the dynamic nominal. A relative flow setpoint is determined based on a current flow setpoint and the dynamic nominal. The operation position of the flow control element is controlled based the operation relative flow and relative flow setpoint.

The above-described features and advantages, as well as others, will become more readily apparent to those of ordinary skill in the art by reference to the following detailed description and accompanying drawings. While it would be desirable to provide one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects.

DETAILED DESCRIPTION

Figure 1:
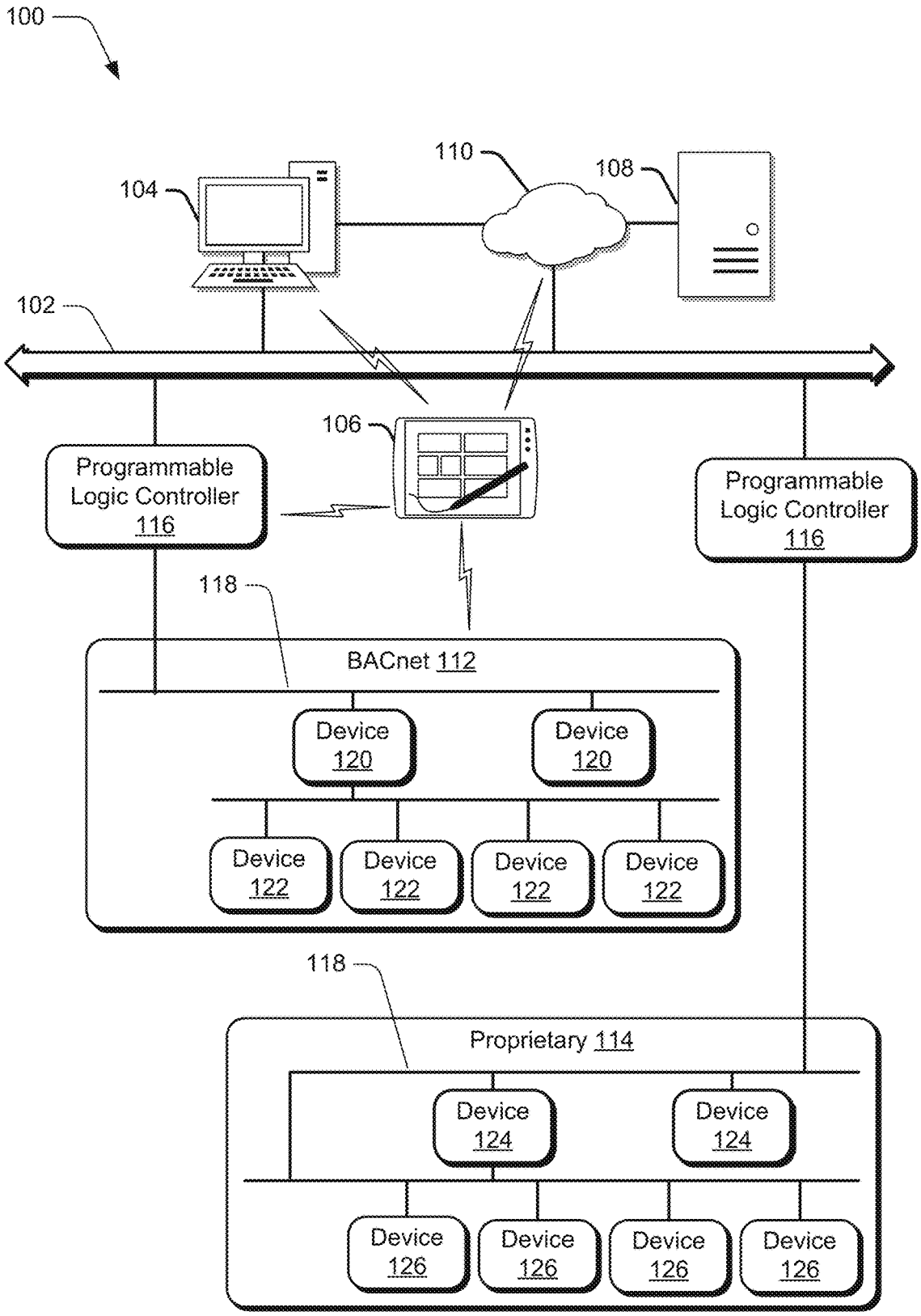
FIG. 1 is an illustration of a building automation system in an example implementation that is operable to employ techniques described herein.

Various technologies that pertain to systems and methods that facilitate dynamic calculations of nominal flow will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

The systems and methods utilize the position of an actuator and measured pressure loss across a control element as inputs to a data store to calculate a nominal value (e.g., nominal airflow). A measured pressure drop corresponds to a particular position of a control element of the flow unit. A calibration pressure drop at full open is established based on the measured pressure drop at full open, and calibration relative pressure drops are calculated based on a calibration pressure drop at full open and calibration measured pressure drop corresponding to calibration positions of the flow control element. After calibration, an operation measured pressure drop of the flow unit and an operation position of the flow control element are detected. A dynamic pressure drop at full open is determined based on the operation measured pressure drop and a particular calibration relative pressure drop corresponding to the operation position of the flow control element. The dynamic nominal can then be calculated using a coefficient (k) multiplied by the square root of the dynamic pressure drop at full open.

$$Q_{nominal} = k\sqrt{P_{open}}$$

Referring to FIG. 1, there is shown a building automation system ("BAS") 100 in an example implementation that is operable to employ techniques described herein. The BAS 100 includes an environmental control system configured to control one or more environmental parameters for a facility, such as airflow, air pressure, air temperature, fluid flow, fluid pressure, fluid temperature, and the like. For example, the BAS 100 may comprise one or more network connections or primary buses 102 for connectivity to components of a management level network ("MLN") of the system. For one embodiment, the example BAS 100 may comprise one or more management level devices or management devices, such as a management workstation 104, a mobile device 106, or a remote management device 108 connecting through a wired or wireless network 110, that allows the setting and/or changing of various controls of the system. For example, a management device may be a mobile device connecting through a wired or wireless link to an individual automation or field level device, such as a controller 120-126, that allows the setting and/or changing of various controls of the device. While a brief description of the BAS 100 is provided below, it will be understood that the BAS 100 described herein is only one example of a particular form or configuration for a BAS. The system 100 may be implemented in any other suitable manner without departing from the scope of this disclosure. The management devices are configured to provide overall control and monitoring of automation devices, field devices, and other controllers of the BAS 100.

For the illustrated embodiment of FIG. 1, the BAS 100 provides connectivity based on one or more communication protocols to subsystems for various environmental parameters, such as components of environmental comfort systems. Each subsystem 112, 114 may include various automation level devices 120, 124 ("automation controllers") for monitoring and controller field devices as well as various field level devices 122, 126 ("field controllers") for monitoring and controlling areas within a building or group of buildings. For field controllers 122, 126 that monitor and control air and/or fluid heating-cooling HVAC equipment, the field controllers may include, but are not limited to, actuators, sensors, and other types of controllers for the HVAC equipment, such as heating/cooling generators, fans, dampers, filters, pumps, compressors, condensers, evaporators, tanks/reservoirs, valves, bypass mechanisms, and the like.

For some embodiments, the BAS 100 may include one or more programmable logic controllers 116 for connectivity to components of a building level network (BLN) of the system 100. Each programmable logic controller 116 may connect the primary bus 102 of the MLN to a secondary bus 118 of the BLN. Each programmable logic controller 116 may also include management logic for switching, power quality, and distribution control for the BLN components. For example, automation controllers 120, 122 may communicate directly with the network connection or secondary bus 118 of the BLN, whereas field controllers 124, 126 may communicate through, and controlled by, the automation controllers.

In these illustrative embodiments, objects associated with the BAS 100 include data created, processed, and stored by the automation controllers 120, 124 and the field controllers 122, 126, such as temperature data, pressure data, and air/fluid flow, as well as analytical data, such as control schedules, trend reports, defined system hierarchies, and the like. The illustration of the BAS 100 in FIG. 1 is not meant to imply physical or architectural limitations to the manner in which different illustrative embodiments may be implemented. Other components in addition to and/or in place of the ones illustrated may be used, and some components may be unnecessary in some illustrative embodiments.

Figure 2:
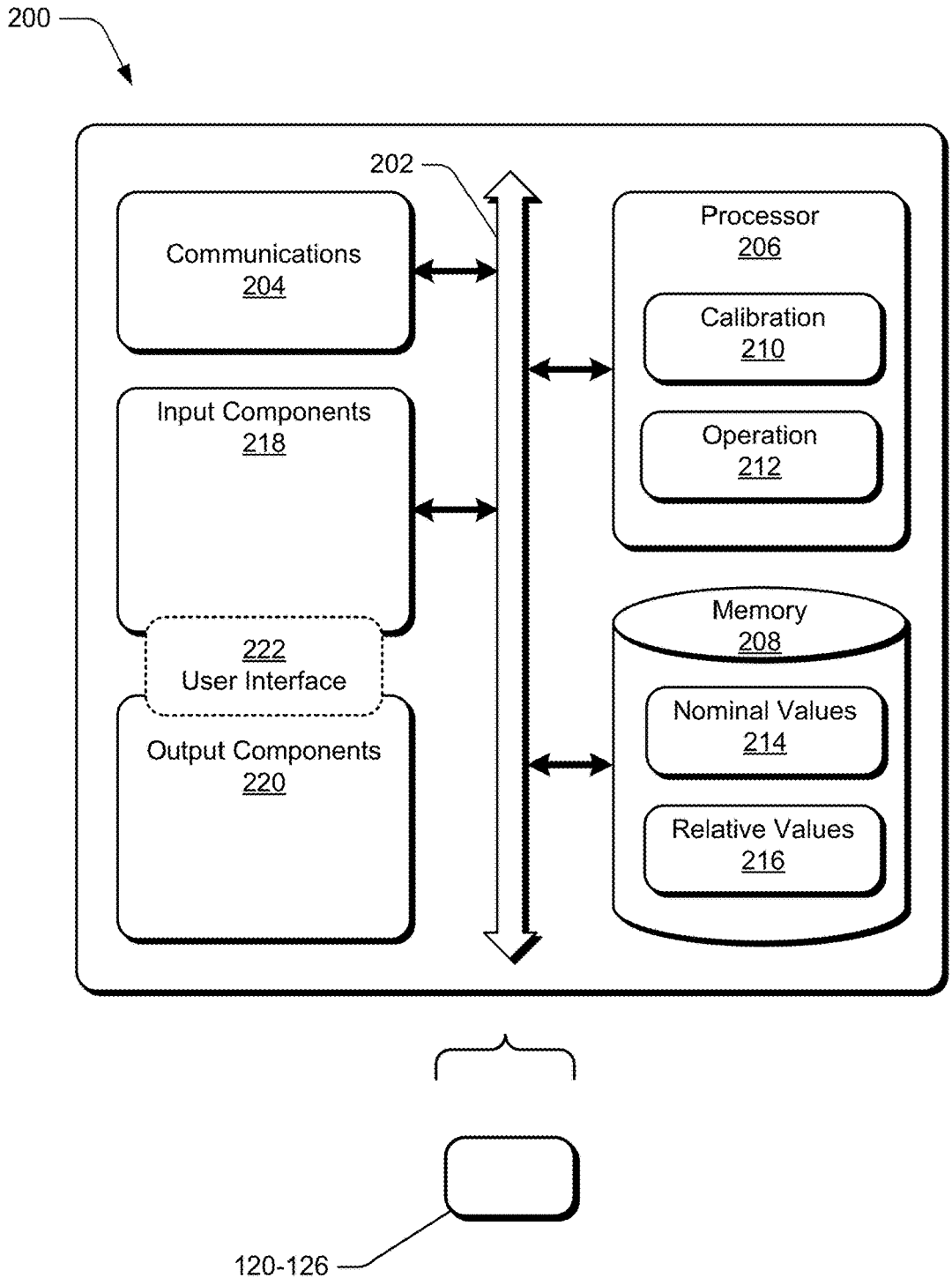
FIG. 2 is a block diagram of a controller in an example implementation which is part of the building automation system of FIG. 1.

FIG. 2 represents example device components 200 of one or more controllers 120-126 of the building automation system 100, described above in reference to FIG. 1, in an example implementation. The device components 200 comprise a communication bus 202 for interconnecting other device components directly or indirectly. The other device components include one or more communication components 204 communicating with other entities via a wired or wireless network, one or more processors 206, and one or more memory components 208.

The communication component 204 communicates (i.e., receives and/or transmits) data associated with one or more devices of the system 100, such as another controller 120-126 or a management device 104-108. The communication component 204 may utilize wired technology for communication, such as transmission of data over a physical conduit, e.g., an electrical or optical fiber medium. The communication component 204 may also utilize wireless technology for communication, such as radio frequency (RF), infrared, microwave, light wave, and acoustic communications. RF communications include, but are not limited to, Bluetooth (including BLE), ultrawide band (UWB), Wi-Fi (including Wi-Fi Direct), Zigbee, cellular, satellite, mesh networks, PAN, WPAN, WAN, near-field communications, and other types of radio communications and their variants.

The processor or processors 206 may execute code and process data received from other components of the device components 200, such as information received at the communication component 204 or stored at the memory component 208. The code associated with the controller 120-126 and stored by the memory component 208 may include, but is not limited to, operating systems, applications, modules, drivers, and the like. An operating system includes executable code that controls basic functions, such as interactions among the various components of the device components 200, communication with external devices via the communication component 204, and storage and retrieval of code and data to and from the memory component 208.

Each application includes executable code to provide specific functionality for the processor 206 and/or remaining components of the controller 120-126. Examples of applications executable by the processor 206 include, but are not limited to, a calibration module 210 and an operation module 212. The calibration module 210 establishes a calibration pressure drop at full open based on the measured pressure drop for a flow control element at a maximum open position, and the module calculates calibration relative values based on the calibration pressure drop at full open and calibration measured pressure drops corresponding to different calibration positions of the flow control element. The operation module 212 determines a dynamic nominal based on the operation measured pressure drop and a particular calibration value of calibration relative values corresponding to the operation position of the flow control element. The operation modules 212 also determines an operation relative flow based on the operation measured pressure drop and the dynamic nominal and determines a relative flow setpoint based on a current flow setpoint and the dynamic nominal.

Data stored at the memory component 208 is information that may be referenced and/or manipulated by an operating system or application for performing functions of the controller 120-126. Examples of data associated with the controller 120-126 and stored by the memory component 208 may include, but are not limited to, nominal values 214 and relative values 216. Examples of the nominal values 214 include the calibration pressure drop at full open generated when calibrating the controller and the dynamic nominal generated when operating the controller. Examples of the relative values include the calibration relative pressure drops generated when calibrating the controller 120-126 and the operation relative flow and relative flow setpoint ("relative flow setpoint") generated when operating the controller.

The device components 200 may include one or more input components 218 and one or more output components 220. One or more input components 218 detect a measured full flow and pressure drop corresponding to a full open position of a flow control element of the flow unit that is controlled by the controller 120-126. The one or more input components 218 also detect an operation measured flow and pressure drop of the flow unit and an operation position of the flow control element. One or more output components 220 control the operation position of the flow control element based on the operation relative flow and the relative flow setpoint.

The input components 218 and output components 220 of the device components 200 may also include one or more visual, audio, mechanical, and/or other components. For some embodiments, the input and output components 218, 220 may include a user interface 222 for interaction with a user of the device. The user interface 222 may include a combination of hardware and software to provide a user with a desired user experience.

It is to be understood that FIG. 2 is provided for illustrative purposes only to represent examples of the controller 120-126 and is not intended to be a complete diagram of the various components that may be utilized by the system 100. Therefore, the controller 120-126 may include various other components not shown in FIG. 2, may include a combination of two or more components, or a division of a particular component into two or more separate components, and still be within the scope of the present invention.

Figure 3:
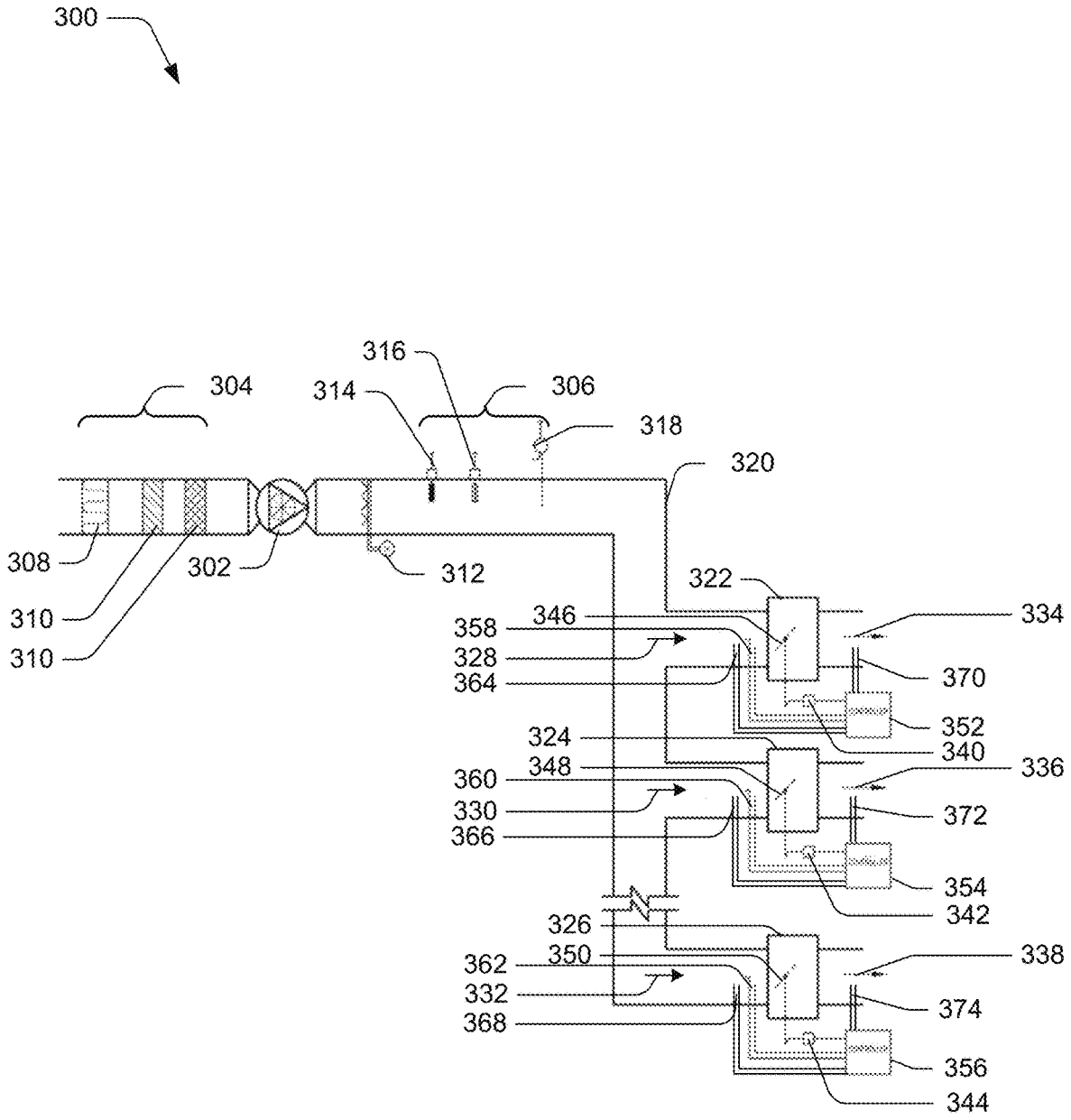
FIG. 3 depicts a simplified heating, ventilation, and air conditioning ("HVAC") unit in an example implementation that is managed by the building automation system of FIG. 1.

Referring to FIG. 3, there is shown a simplified environmental control unit 300, such as a heating, ventilation, and air conditioning ("HVAC"), in an example implementation that may be managed by the building automation system. Although the environmental control unit 300 is shown in FIG. 3 as an HVAC unit by example, it is to be understood that the techniques described herein may be applied to flow devices of a building automation system that manage the flow of a variety of mediums including gas and liquid. For example, any reference to airflow throughout this disclosure may also apply to fluid flow and vice versa. Similarly, reference to fans may also apply to pumps, and so on.

The controllers, methods, and media employ the techniques described herein to calibrate and operate each flow unit of the environmental control unit 300 to accommodate, or compensate for, modulation changes to the maximum flow through any of the flow units. The environmental control unit 300 includes a flow source 302 such as a fan or pump. For some embodiments, the environmental control unit 300 also includes upstream components 304 positioned upstream from the flow source and/or downstream components position 306 downstream from the flow source. Examples of components that may be positioned upstream and/or downstream of the flow source 302 include, but are not limited to filters 308, heating and/or cooling coils 310, humidifiers 312, and sensors 314-318. The sensors may include a pressure sensor 318 (also known as a pressure transmitter) to operate the flow source 302 so that it maintains the pressure sensor to a desired setpoint. In this manner, as the setpoint of the pressure sensor 318 is modulated, the speed of the flow source 302 changes the performance of other devices along the pipe or duct 320 downstream from the flow source. The controllers, methods, and media optimize the performance of flow devices downstream from the flow source in view of these modulation changes to the maximum flow.

The environmental control unit 300 further includes multiple flow units 322-326, positioned downstream from the flow source 302. Each flow unit includes a flow inlet 328-332 and a flow outlet 334-338, and each flow unit is associated with a maximum flow rate and a minimum flow rate. For example, a first flow unit 322 may have a maximum flow rate of 1100 CFM and a minimum flow rate of 175 CFM. Where the flow rate of the first flow unit 322 changes from 175 to 1100, the flow from the flow source 302 through the pipe or duct 320 to the first terminal unit 322 increases. The increase in total flow of the flow unit 322-326 increases any pressure drop along the pipe or duct 320 between the flow source 302 and the rest of the system, i.e., the environmental control unit 300. As the pressure changes at the inlet 328-332 of each flow unit 322-326, the maximum amount of flow that may be achieved when the flow unit is at full open changes.

The environmental control unit 300 includes controllers 352-356 to manage the calibration and operation of the flow units 322-326. In particular, each flow unit 322-326 includes a flow control element 346-350, such as an air damper or a fluid valve, which is controlled by a corresponding controller 352-356. For example, the environmental control unit 300 may include an actuator 340-344 for each flow unit 322-326 that is managed by a corresponding controller 352-356 and controls a corresponding flow control element 346-350. Thus, the controllers 352-356 of the building automation system control flow control element 346-350 of the environmental control unit 300.

The building automation system may also include flow sensors 358-362 that provide flow sensor data to the corresponding controller 352-356. The building automation system may further include pre-unit pressure sensors 364-368 and post-unit pressure sensors 370-374. The pressure sensors 364-370 detect pressure measurements from static pressure probes positioned in the flow path across the flow control element 346-350, determines a differential pressure based on the pressure measurements of the post-unit pressure sensors 370-374 and the pre-unit pressure sensors 364-368, and provides a signal to the controller 352-356 representing the differential pressure. For example, the pressure sensors 364-370 may include pre-unit and post-unit probes in the flow path and coupled to a differential pressure transducer, which sends a differential pressure signal based on the pressure measurements of the probes to the controller 352-356.

Each controller 352-356 manages the corresponding flow control element 346-350 by modulating its output to drive the corresponding the actuator 340-344 and to control setpoints for the sensors 358-374. The pressure sensors 364-374 are more effective than the flow sensors 358-362 for measurements taken when the flow control element 346-350 is closer to being in the closed position. The flow sensors 358-362 are more effective than the pressure sensors 364-374 for measurements taken when the flow control element 346-350 is closer to being in the opened position. Thus, utilization of both types of sensors, i.e., the flow sensors 358-362 and the pressure sensors 364-374, allows for optimal measurements of dynamic nominal for any and/or all positions of the flow control elements 346-350.

Figure 4:
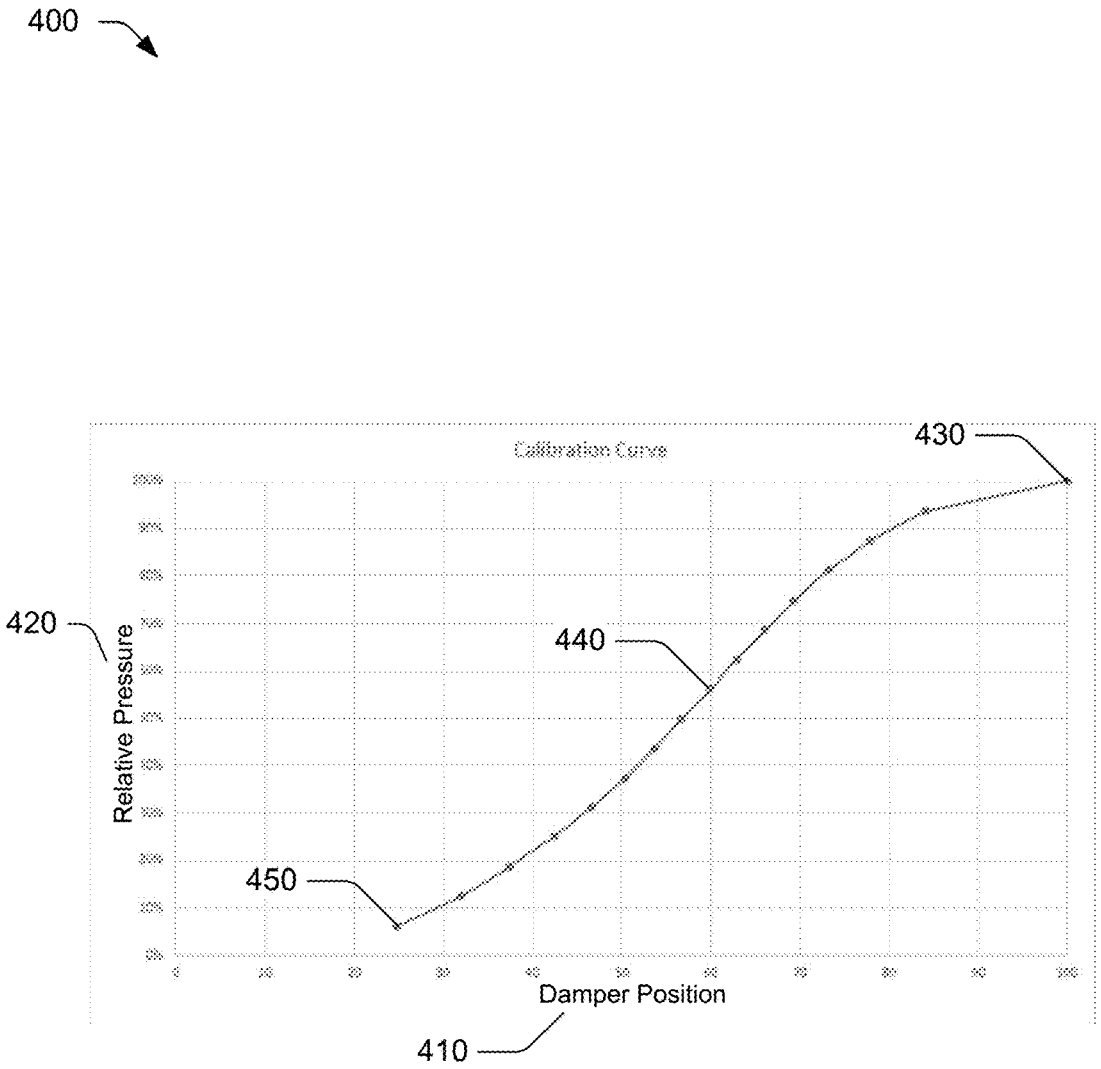
FIG. 4 is a graphic view of a calibration curve correlating positions of a flow control element to relative pressure drops, which represents calibration data for an example controller.

Referring to FIG. 4, there is shown a graph view of a calibration curve 400 correlating flow control element positions 410 to relative pressure drops 420, which represents calibration data for an example controller. The flow control element positions 410 and/or the relative pressure drops 420 may be represented by percentages, ratios, or other mathematical values. It is to be understood that the calibration curve is a representation of data stored by the controller of the flow unit. For example, each controller may include a memory component storing a table of relative pressure drop and corresponding flow control element position values that are represented by the calibration curve 400. For another example, each controller may include a processor implementing an equation for calculating the relative pressure drop and the corresponding flow control element position values represented by the calibration curve 400.

For the embodiment shown in FIG. 4, the flow control element positions 410 are represented by the x-axis in terms of percent open relative to a maximum open position, and the relative pressure drop 420 is represented by the y-axis in terms of percent pressure drop relative to a calibrated pressure drop at full open. For some embodiments, the maximum open position is a position of a damper or valve when the damper or valve is fully open. For some embodiments, the calibrated pressure drop at full open is a measured pressure drop of a damper or valve of a flow unit when the damper or valve is fully open. For the embodiment shown in FIG. 4, maximum open position and the corresponding pressure drop are represented by example as a full open point 430 of measured pressure drop corresponding to a full open position of the flow control element.

The calibration process includes measuring the calibration pressure drop at full open at current fan or propulsion system pressures. The calibration pressure drop at full open is the filtered pressure drop, such as an average pressure drop measured over a period of a predetermined time period. For example, the system commands the flow control element to assume the full open position at 100%, and the measured pressure drops are averaged by taking the averages of the pressure drop.

Calibration relative pressure drops 430, 440, 450 may be calculated based on the calibration pressure drop at full open, in which calibration measured pressure drops corresponding to different calibration positions of the flow control element. For example, for the embodiment shown in FIG. 4, an interim point 440 represents a 57% ratio of the calibrated pressure drop at full open relative to a calibrated measured pressure drop at 60% flow control element position. Likewise, a minimum point 450 represents a 7% ratio of the calibrated pressure drop at full open relative to a calibrated measured pressure drop at 25% flow control element position. For example, the flow control element may be commanded from 100% open in sequential steps, the relative pressure drop at each flow control element position may be recorded, and the process may continue until a predetermined number of data points or a minimum relative pressure drop is reached.

Subsequent to calibration of the system, dynamic nominal may be determined for any condition during operation of the flow unit. The calibration curve 400 provides data 430-450 for determining the dynamic nominal. In particular, the calibration curve 400 and a current position of the flow control element during operation are used to determine the dynamic nominal. For some embodiments, the dynamic pressure drop at full open is the current pressure drop multiplied by the calibration relative pressure drop corresponding to the position of the flow control element, identified by the calibration curve 400. The dynamic nominal is the coefficient (k) multiplied by the square root of the dynamic pressure drop at full open.

Relative airflow and relative airflow setpoint may be determined based on the dynamic nominal. For some embodiments, the relative airflow is the current airflow divided by the dynamic nominal, and the relative airflow setpoint is the airflow setpoint divided by the dynamic nominal. Again, the quotient may be multiplied by 100 if percentages are desired or utilized. By using the dynamic nominal, tuning of the flow unit is normalized (i.e., consistent tuning) and the resulting tuning parameters may be utilized across many types of system pressures. Since system pressures may vary for each type of environmental management unit as explained above, the controllers and methods implementing the techniques described herein are able to operate across a wide variety of system pressures. The dynamic nominal allows for prediction of nominal flow even with changing conditions in the system. For some embodiments, the dynamic nominal is used for turning and/or auto-adjusting reactions of proportional integral derivative ("PID") loop to changing conditions of the system.

Figure 5:
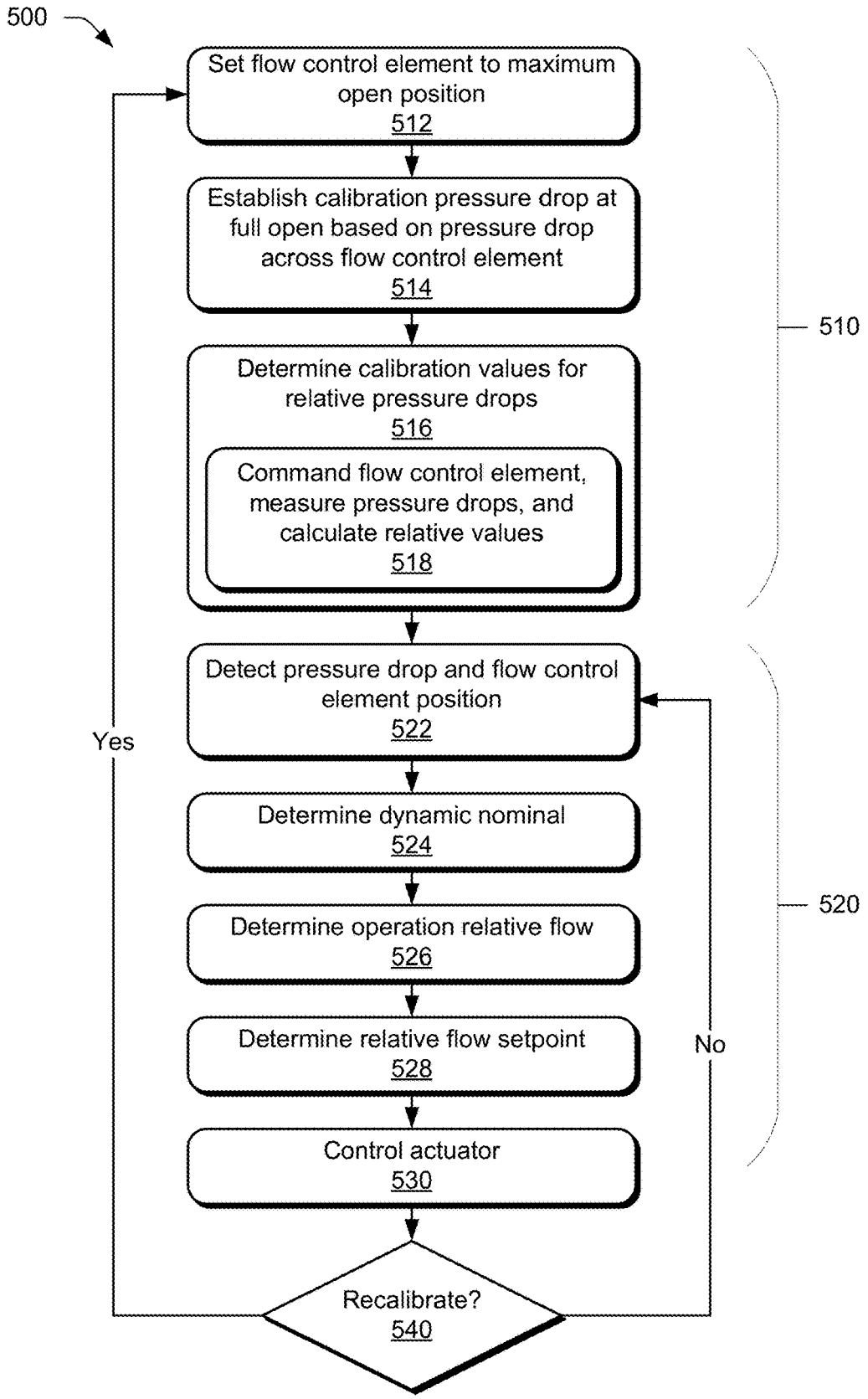
FIG. 5 is a flow diagram depicting calibration and operation of a controller for a flow unit in an example implementation that is operable to employ techniques described herein.

Referring to FIG. 5, there is shown a flow diagram depicting calibration and operation processes 500 of a controller 120-126, 340-344 for a flow unit 322-326. Specifically, the processes 500 include calibrating (510) the controller of the flow unit and operating (520) the controller of the flow unit subsequent to calibrating the controller.

The controller 340-344 (also 120-126 of FIG. 1) for a flow unit 322-326 is calibrated (510) by detecting (512) a measured pressure drop and/or flow, establishing (514) a calibration pressure drop at full open, and determining (516) calibration values. The controller 340-344 controls a flow control element 346-350 of the flow unit 322-326 and detects (512) the measured full power drop and/or flow of the flow unit. The measured full flow corresponds to a full open position of the flow control element of the flow unit. In response to detecting (512) the measured pressure drop and/or flow, the controller 340-344 establishes (514) the calibration pressure drop at full open based on the measured pressure drop. For some embodiments, the controller may establish the calibration pressure drop at full open by identifying a filtered pressure drop of the measured pressure drop, such as an average over a predetermined time period. For some embodiments, the controller 340-344 may establish the coefficient (k) based on calibration pressure drop at full open, i.e., when the flow control element is at the full open position. The calibration pressure drop at full open is determined at calibration based on the pressure drop at the full open position of the flow control element. The coefficient (k) is determined at calibration based on the pressure drop and the flow at the full open position of the flow control element, so that the coefficient may be used during operation.

In response to establishing (514) the calibration pressure drop at full open, the controller 340-344 calculates (516) calibration relative values based on the calibration pressure drop at full open and calibration measured pressure drops corresponding to different calibration positions of the flow control element 346-350. For some embodiments, the controller determines (518) the calibration relative values by commanding flow control element positions and determining a calibration relative pressure drop for the flow control element positions. In particular, the controller commands (518) the flow control element to reduce its open state in steps for the different calibration positions of the flow control element. Also, the controller determines (518) the calibration relative value based on each measured pressure drop of the measured pressure drop and the calibration pressure drop at full open. Each calibration relative pressure drop corresponds to each calibration position of the flow control element.

For some embodiments, the controller 340-344 may calculate (516) calibration relative values based on the calibration measured pressure drops, the calibration pressure drop at full open, and the different calibration positions of the flow control element. In turn, the controller 340-344 determines the operation relative flow and the relative flow setpoint based on the conversion equation.

Subsequent to calibrating (510) the controller 340-344, the controller operates (520) by detecting (522) operation measured pressure drop, determining (524) a dynamic nominal, determining an operation relative flow and an operation relative flow setpoint (526, 528), and controls (530) the flow control element 346-350 of the flow unit 322-326. The controller 340-344 detects (522) the operation measured pressure drop of the flow unit and an operation position of the flow control element. In response to detecting (522) the operation measured pressure drop, the controller 340-344 determines (524) a dynamic nominal based on the dynamic pressure drop at full open, which is the operation measured pressure drop and a particular calibration relative pressure drop corresponding to the operation position of the flow control element 346-350. The particular calibration relative value may be selected from the calibration relative values calculated during the previous calibration process (510). For some embodiments, the controller determines the dynamic nominal, based on the dynamic pressure drop at full open, by determining the particular calibration relative pressure drop based on linearization of two or more values of the calibration relative values where the calibration relative pressure values do not include a calibration relative pressure drop for a particular operation position of the flow control element.

In response to determining (524) the dynamic nominal, the controller 340-344 determines the operation relative flow and an operation relative flow setpoint (526, 528). The controller 340-344 determines (526) the operation relative flow based on the current measured flow and the dynamic nominal. The controller 340-344 determines (528) the operation relative flow setpoint based on a current flow setpoint and the dynamic nominal. In particular, the current flow setpoint is determined based on data, other than the operation measured pressure drop, from a source external to the controller. The current flow setpoint may be determined at the controller or a device remote from the controller, such as a device 352-356 similar to a BAS controller or a management device 104-108.

In response to determining the operation relative flow and an operation relative flow setpoint (526, 528), the controller 340-344 controls (530) the operation position of the flow control element 346-350 based the operation relative flow and relative flow setpoint. For some embodiments, the controller controls the operation position of the flow control element by receiving the operation relative flow and relative flow setpoint at a control loop of the controller. The control loop of the controller may receive the operation relative flow and relative flow setpoint in response to a change in the operation relative flow, the relative flow setpoint, or both.

Subsequent to the calibrating (510) and operating (520) the controller 340-344, the controller may recalibrate if conditions of the flow unit 322-326, environmental control unit 300, or building automation system 100 change, such as change in component configuration, recalibration of a pressure measuring device, or some other type of alteration to one or more system characteristics.

Although a single calibration may be sufficient for continuing operation of a controller 120-126, 340-344 for a flow unit 322-326, calibration and operation processes 500 may be performed multiple times for a particular controller.

Recalibration (540) of a controller 120-126, 340-344 may initiated by a manual input by a technician or operator or by automatic operation of the controller in response to one or more detected conditions of the system. Examples of such conditions include, but are not limited to, changes to configuration, changes to the system, and/or upkeep activities. For example, the controller 120-126, 340-344 may recalibrate (540) by performing the calibration and operation processes 500 in response to general maintenance or balancing of the system based on one or more airflow measurements.

Those skilled in the art will recognize that, for simplicity and clarity, the full structure and operation of all data processing systems suitable for use with the present disclosure are not being depicted or described herein. Also, none of the various features or processes described herein should be considered essential to any or all embodiments, except as described herein. Various features may be omitted or duplicated in various embodiments. Various processes described may be omitted, repeated, performed sequentially, concurrently, or in a different order. Various features and processes described herein can be combined in still other embodiments as may be described in the claims.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an example embodiment of the present disclosure has been described in detail, those skilled in the art will understand that various changes, substitutions, variations, and improvements disclosed herein may be made without departing from the spirit and scope of the disclosure in its broadest form.

What is claimed is:

1. A controller for managing a flow unit comprising:

an input component configured to detect a measured pressure drop across a flow control element of the flow unit at a maximum open position, detect a plurality of calibration measured pressure drops corresponding to a plurality of different calibration positions of the flow control element, and detect an operation measured pressure drop of the flow unit and an operation position of the flow control element, wherein the flow control element includes a variable position damper or valve in a flow path of an HVAC system;

a processor configured to:

establish a calibration pressure drop at full open based on the measured pressure drop across the flow control element of the flow unit at the maximum open position, determine a plurality of calibration values for relative pressure drops based on the calibration pressure drop at full open and the plurality of calibration measured pressure drops, determine a dynamic nominal based on the operation measured pressure drop and a particular calibration value of the plurality of calibration values corresponding to the operation position of the flow control element, and determine an operation relative flow based on a current measured flow and the dynamic nominal and determine a relative flow setpoint based on a current flow setpoint and the dynamic nominal; and an output component configured to control the operation position of the flow control element based on the operation relative flow and the relative flow setpoint, wherein the output component controls the operation position by sending control signals to an actuator that physically adjusts the flow control element to regulate flow through the HVAC system.

2. The controller as described in claim 1, wherein the processor identifies a filtered pressure drop of the measured pressure drop while establishing the calibration pressure drop at full open.

3. The controller as described in claim 1, wherein the processor commands the flow control element to reduce its open state in steps for the different calibration positions of the flow control element; and determines a calibration relative pressure drop corresponding to each calibration position of the flow control element based on each calibration measured pressure drop and the calibration pressure drop at full open.

4. The controller as described in claim 1, wherein the processor determines the particular calibration value based on linearization of two or more values of the plurality of calibration values where the plurality of calibration values do not include a calibration relative pressure drop for a particular operation position of the flow control element.

5. The controller as described in claim 1, wherein the processor:

determines a conversion equation based on the plurality of calibration measured pressure drops, the calibration pressure drop at full open, and the plurality of different calibration positions of the flow control element, wherein:

determines the operation relative pressure drop includes determining the operation relative pressure drop based on the conversion equation; and determines the relative flow setpoint includes determining the relative flow setpoint based on the conversion equation.

6. The controller as described in claim 1, wherein the current flow setpoint is based on data from a source external to the controller.

7. A method of a controller for managing a flow unit, the method comprising:

calibrating the controller of the flow unit comprising:

establishing a calibration pressure drop at full open based on a measured pressure drop across a flow control element of the flow unit at a maximum open position, wherein the flow control element includes a variable position damper or valve in a flow path of an HVAC system; and determining a plurality of calibration values for relative pressure drops based on the calibration pressure drop at full open and a plurality of calibration measured pressure drops corresponding to a plurality of different calibration positions of the flow control element; and operating the controller of the flow unit, subsequent to calibrating the controller, comprising:

detecting an operation measured pressure drop of the flow unit and an operation position of the flow control element;

determining a dynamic nominal based on the operation measured pressure drop and a particular calibration value of the plurality of calibration values corresponding to the operation position of the flow control element;

determining an operation relative flow based on a current measured flow and the dynamic nominal;

determining a relative flow setpoint based on a current flow setpoint and the dynamic nominal; and controlling the operation position of the flow control element based the operation relative flow and relative flow setpoint by sending control signals to an actuator that physically adjusts the flow control element to regulate flow through the HVAC system.

8. The method as described in claim 7, wherein establishing the calibration pressure drop at full open includes identifying a filtered pressure drop of the measured pressure drop.

9. The method as described in claim 7, wherein determining the plurality of calibration values comprises:

commanding the flow control element to reduce its open state in steps for the different calibration positions of the flow control element; and determining a calibration relative pressure drop corresponding to each calibration position of the flow control element based on each calibration measured pressure drop and the calibration pressure drop at full open.

10. The method as described in claim 7, wherein determining the dynamic nominal includes determining the particular calibration value based on linearization of two or more values of the plurality of calibration values where the plurality of calibration values do not include a calibration relative pressure drop for a particular operation position of the flow control element.

11. The method as described in claim 7, further comprising determining a conversion equation based on the plurality of calibration measured pressure drops, the calibration pressure drop at full open, and the plurality of different calibration positions of the flow control element, wherein:

determining the operation relative pressure drop includes determining the operation relative pressure drop based on the conversion equation; and determining the relative flow setpoint includes determining the relative flow setpoint based on the conversion equation.

12. The method as described in claim 7, wherein the current flow setpoint is based on data from a source external to the controller.

13. A non-transitory computer readable medium including executable instructions which, when executed, causes at least one processor to manage a flow unit by:

calibrating a controller of the flow unit comprising:

establishing a calibration pressure drop at full open based on a measured pressure drop across a flow control element of the flow unit at a maximum open position, wherein the flow control element includes a variable position damper or valve in a flow path of an HVAC system; and determining a plurality of calibration values for relative pressure drops based on the calibration pressure drop at full open and a plurality of calibration measured pressure drops corresponding to a plurality of different calibration positions of the flow control element; and operating the controller of the flow unit, subsequent to calibrating the controller, comprising:

detecting an operation measured pressure drop of the flow unit and an operation position of the flow control element;

determining a dynamic nominal based on the operation measured pressure drop and a particular calibration value of the plurality of calibration values corresponding to the operation position of the flow control element;

determining an operation relative flow based on a current measured flow and the dynamic nominal;

determining a relative flow setpoint based on a current flow setpoint and the dynamic nominal; and controlling the operation position of the flow control element based the operation relative flow and relative flow setpoint by sending control signals to an actuator that physically adjusts the flow control element to regulate flow through the HVAC system.

14. The non-transitory computer readable medium as described in claim 13, wherein establishing the calibration pressure drop at full open includes identifying a filtered pressure drop of the measured pressure drop.

15. The non-transitory computer readable medium as described in claim 13, wherein determining the plurality of calibration values comprises:

commanding the flow control element to reduce its open state in steps for the different calibration positions of the flow control element; and determining a calibration relative pressure drop corresponding to each calibration position of the flow control element based on each calibration measured pressure drop and the calibration pressure drop at full open.

16. The non-transitory computer readable medium as described in claim 13, further comprising determining a conversion equation based on the plurality of calibration measured pressure drops, the calibration pressure drop at full open, and the plurality of different calibration positions of the flow control element, wherein:

determining the operation relative pressure drop includes determining the operation relative pressure drop based on the conversion equation; and determining the relative flow setpoint includes determining the relative flow setpoint based on the conversion equation.

17. The non-transitory computer readable medium as described in claim 13, wherein the current flow setpoint is based on data from a source external to the controller.

* * * * *